US006546216B2

(12) United States Patent
Mizoguchi et al.

(10) Patent No.: US 6,546,216 B2
(45) Date of Patent: Apr. 8, 2003

(54) TONER SUPPLYING UNIT FOR A DEVELOPING APPARATUS

(75) Inventors: Fumito Mizoguchi, Yamatokoriyama (JP); Kiyoshi Morimoto, Osaka (JP); Arihiro Tsunoda, Higashiosaka (JP); Hisashi Kunihiro, Nara (JP); Takeshi Wakabayashi, Kyoto (JP); Hiroshi Tanizawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/940,465

(22) Filed: Aug. 29, 2001

(65) Prior Publication Data

US 2002/0025197 A1 Feb. 28, 2002

(30) Foreign Application Priority Data

Aug. 29, 2000 (JP) ..... 2000-259657

(51) Int. Cl.[7] ..... G03G 15/08

(52) U.S. Cl. ..... 399/106; 399/258; 399/260; 399/262

(58) Field of Search ..... 399/106, 258, 399/260, 262, 263

(56) References Cited

U.S. PATENT DOCUMENTS 5,671,461 A * 9/1997 Ishii ..... 399/262 X
5,987,286 A * 11/1999 Shin et al. ..... 399/258
6,185,400 B1 * 2/2001 Sanchez et al. ..... 399/260

FOREIGN PATENT DOCUMENTS

JP 08-076578 3/1996

* cited by examiner

*Primary Examiner*—William J. Royer
(74) *Attorney, Agent, or Firm*—Birch, Stewart, Kolasch & Birch, LLP

(57) ABSTRACT

A flexible element for converting an opening port of a toner supply container in an openable and closable manner is provided so that, when the toner supply container is joined to a developing unit, an external force acting on the developing unit or toner supplying container, deforms the flexible element to uncover the opening and when the toner supply container and developing unit are separated one from another, the opening port is covered by the flexible element.

6 Claims, 3 Drawing Sheets

TONER SUPPLYING UNIT FOR A DEVELOPING APPARATUS

BACKGROUND OF THE INVENTION (1) Field of the Invention

The present invention relates to a toner supply unit for toner supply to a developing unit provided in an image forming apparatus such as a copier, printer, facsimile machine or the like.

(2) Description of the Prior Art

In image forming apparatus such as copiers, printers, facsimile machines and the like, for charging the toner into an empty toner supply unit when the apparatus is set up, or when the toner in the toner supply unit has been used up after repeated operations of image forming and hence it has been determined that the residual toner held in the toner storage is almost finished, the most common scenario involves a special technician or the user, using a toner bottle or toner cartridge, and following the specified procedures re-supplying a predetermined amount of toner charged in the container.

However, there is a concern with these toner supply units that the surroundings will be contaminated by toner falling and scattering due to movements and impacts occurring when the unit is attached to and removed from the developing unit. Therefore, for these toner supply units, there are methods as follows which have been proposed in order to prevent the above problem from occurring at the joint between the toner supply unit and developing unit.

For example, a developing unit disclosed in Japanese Patent Application Laid-Open Hei 8 No. 76578, a shutter mechanism is arranged at the joining portion between the toner supply unit and the developing unit so that the shutter mechanism will be closed upon toner supply or upon its attachment and removal, whereby occurrence of surrounding contamination due to toner falling and scattering is prevented.

There is also a toner supply unit configuration in which an elastic sheet element, which is used to agitate the toner held in the toner supply unit, has an extension from its distal end so as to close the opening port for establishing connection from the bottom of the toner supply unit to the developing unit. In such a device, the extended part is pulled out from the opening when the agitator begins rotating for the start of use after attachment of the toner supply unit to the developing unit.

A device incorporating a shutter mechanism at the joining portion between the toner supply unit and the developing unit, as disclosed in Japanese Patent Application Laid-Open Hei 8 No. 76578, generally has a complex, bulky configuration needing more parts, hence result is unpreferable.

The device for closing the toner supply opening port in which an extension is provided from the distal end of the elastic sheet for toner agitation in the toner supply unit has a simple configuration, but a considerably strong force is needed in order to pull out the sheet end from the toner supply device when the toner supply unit is first operated. Further, since the distal end of the sheet after the removal will come into sliding contact with the inner wall of the toner supply unit, this may cause extra burden on the driving mechanism and may cause degradation of the toner characteristics resulting from frictional abrasion, hence result is unpreferable. It is true that toner falling occurring when the toner supply unit is mounted to the developing unit is prevented, but no consideration is given as to toner falling occurring when it is removed from the developing unit.

SUMMARY OF THE INVENTION

The present invention has been devised in view of the circumstances described above, and it is therefore an object of the present invention to provide a toner supply unit with a simple configuration which allows its easy attachment to and removal from the developing unit and can prevent toner falling and scattering upon the attachment or removal thereof.

In order to achieve the above object, the present invention is configured as follows:

In accordance with the first aspect of the present invention, a toner supply unit, including a toner supply container which is attachable to and removable from a developing unit for developing a static latent image formed on a photoconductor drum, and being configured so that toner is supplied to the developing unit through a slit-shaped opening port formed in the toner supply container when the toner supply container has been joined to the developing unit, is characterized in that a flexible element for covering the opening port in an openable and closable manner is provided so that, when the toner supply container is joined to the developing unit, the external force acted on the developing unit or toner supplying unit deforms the flexible element to release the opening.

In accordance with the second aspect of the present invention, the toner supply unit having the above first feature is characterized in that one longitudinal edge portion of the flexible element is fixed to the exterior wall of the toner supply container while the other side edge portion of the flexible element located on the free end side covers the opening port of the toner supply container in an openable and closable manner.

In accordance with the third aspect of the present invention, the toner supply unit having the above first feature is characterized in that the flexible element has elasticity and the deformation of the flexible element occurring when the toner supply container is joined to the developing unit is adapted to fall within the limit of its elasticity.

In accordance with the fourth aspect of the present invention, the toner supply unit having the above first feature is characterized in that the external force to be acted on the flexible element to release the opening port is obtained when the developing unit is moved from its retracted position to its proximal position with respect to the photoconductor drum.

In accordance with the fifth aspect of the present invention, the toner supply unit having the above first feature is characterized in that the edges at both ends on the free end side of the flexible element are cut inclined inwards toward the free end.

In accordance with the sixth aspect of the present invention, the toner supply unit having the above first feature is characterized in that the edges at both ends on the free end side of the flexible element are rounded on the free end side.

In accordance with the present invention, use of a flexible element that covers the opening port of the toner supply unit in an openable and closable manner, eliminates the necessity of a complex shutter actuating mechanism and a movable structure that can be opened and closed off, thus making it possible to markedly simplify the structure.

Further, the opening port can be released by the deformation of the flexible element when the toner supply container is joined to the developing unit, the operativity for attachment and detachment of the unit can be markedly improved without any need of providing a separate, driving source or extra parts.

In accordance with the present invention, the opening port can be released and closed off by simply providing a flexible element with its one edge portion fixed to the exterior wall.

In accordance with the present invention, it is possible to open or close the opening port using the elasticity of the flexible element itself. That is, when the developing unit and toner supply unit, which have been joined to each other, are separated one from another, the flexible element reverts itself back to the original state by its elasticity thus making it possible to shut off the opening port for toner supply.

In accordance with the present invention, since the joining operation of the developing unit and toner supply unit for releasing the opening port can be made at the same time the developing unit is set close to the photoconductor drum, the dedicated action for joining the developing unit and toner supply unit can be omitted, thus making it possible to improve the operativity and working performance upon attachment and removal.

When the flexible element has rectangular side ends, the flexible element may interfere (come into line contact) with the frame and other parts of the developing unit and is liable to damage itself when the developing unit is attached and removed. In accordance with this configuration of the present invention, since the edges at both ends on the free end side of the flexible element are cut inclined inward, the edges will come into contact with the frame of the developing unit over a smaller area (at points), thus making it possible to reduce impacts so that the flexible element becomes unlikely to break.

When the flexible element has rectangular side ends, the flexible element may interfere (come into line contact) with the frame and other parts of the developing unit and is liable to damage itself when the developing unit is attached and removed. In accordance with this configuration of the present invention, since the edges at both ends of the flexible element are rounded on the free end side, the edges will come into contact with the frame of the developing unit in a smaller area (at points), thus making it possible to reduce impacts so that the flexible element becomes unlikely to break.

DESCRIPTION OF THE PREFERRED EMBODIMENTS

Figure 1:
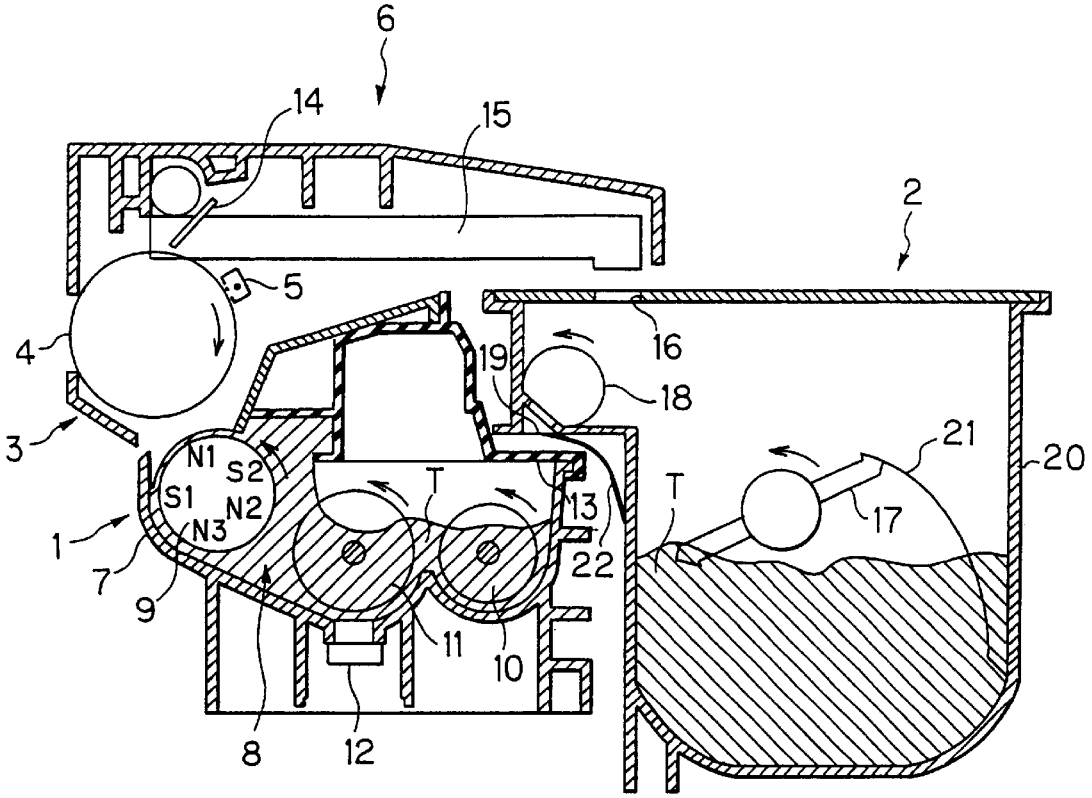
FIG. 1 is a structural view showing a toner supply container according to the embodiment of the present invention, in its separated position.
Figure 2:
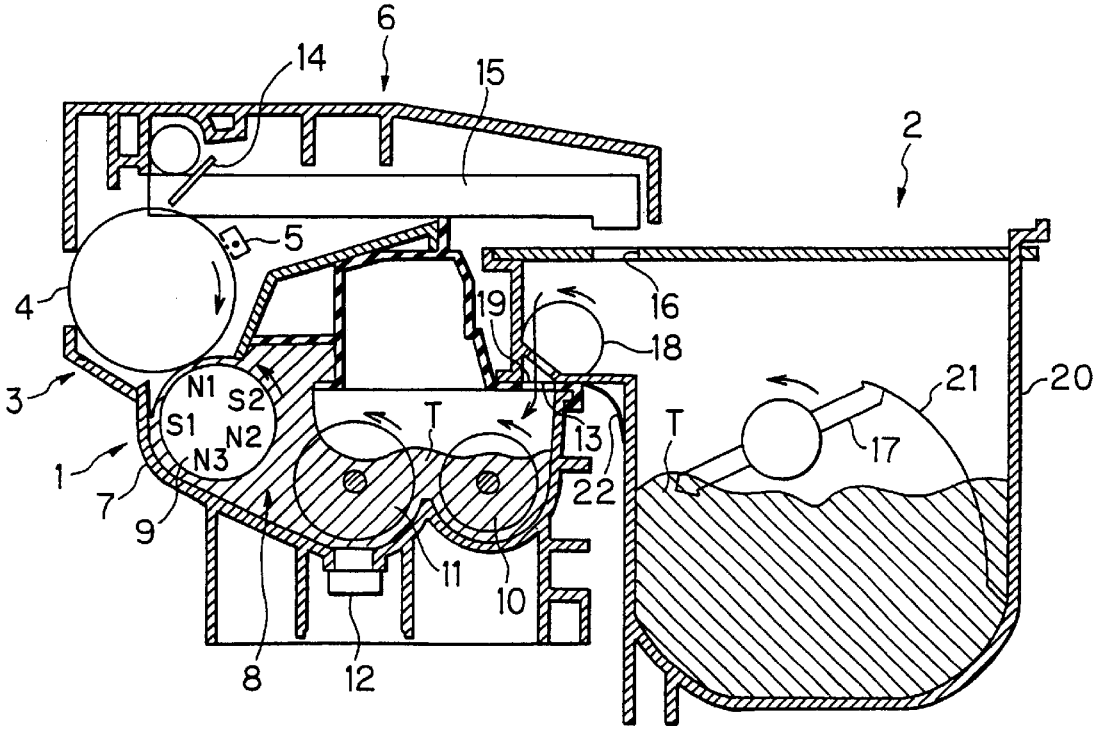
FIG. 2 is a structural view showing the same container in its joined position.

FIGS. 1 and 2 show the configuration around a toner supply unit in accordance with one embodiment of the present invention. FIG. 1 shows a toner supply container (toner cartridge) 2 and a developing unit 1 in their separated state and FIG. 2 shows them in their joined state. In these figures, an image forming apparatus 3 incorporating developing unit 1 has a photoconductor drum 4, around which a charger 5, developing unit 1, unillustrated transfer device and cleaning device 6 are arranged along and in the rotational direction of the drum.

With this arrangement, images are formed by the well-known electrophotographic process in the following manner. First, opposed to the photoconductor drum 4 surface is the open face of charger 5, which is connected to an unillustrated charger power supply. The charger incorporates a tungsten wire of about 60 $\mu$m in diameter and uniformly charges the photoconductor drum surface by controlling the discharge from the tungsten wire with a grid arranged at the opening.

Arranged on the top of photoconductor drum 4 between charger 5 and developing unit 1 is an unillustrated optical unit, which exposes the photoconductor drum surface with light emitted in accordance with original information, whereby a static latent image or a pattern of electric charges, is formed on the photoconductor drum surface.

Developing unit 1 has a developer roller 9 opposing photoconductor drum 4, a first agitating shaft 10 and a second agitating shaft 11 in a developing hopper 8 formed in a casing 7. A toner sensor 12 for detecting the toner concentration is arranged at the bottom of casing 7 while a toner entrance port 13 opens into casing 7 at a position directly above first agitating shaft 10.

Developer roller 9 is comprised of fixed magnets incorporated therein and a nonmagnetic developer sleeve rotatably arranged externally. With a predetermined developing bias voltage applied to the developer sleeve, the sleeve holds on its outer surface the toner and carrier, electrified with opposite polarities to one another, as if a brush were formed by magnetism. The static latent image on photoconductor drum 4 opposing the developer roller 9 is developed with the toner into a visual image.

Next, the developed, toner image formed on photoconductor drum 4 is transferred by the transfer device to a transfer sheet such as OHP film, and the image is fixed by an unillustrated fixing unit made up of a heat roller. Untransferred toner, left on the photoconductor drum surface is cleaned by cleaning device 6 or scraped by a blade 14 formed of urethane, into the cleaning device 6.

Here, the thus scraped, collected toner in cleaning device 6 is conveyed into a collecting duct 15 by unillustrated rotational conveyer vanes in cleaning device 6. Collecting duct 15 conveys the collected toner with the internal rotational conveyer vanes, and drops the toner through the toner collecting port 16 on top of the toner supply container 2 arranged adjacent to developing unit 1, into the toner supply container 2.

The collected toner dropped into toner supply container 2 is mixed by an agitating means 17 with fresh toner supplied from an unillustrated toner bottle and conveyed to a toner supply roller 18 formed of a porous elastic element such as urethane sponge.

Then, in response to a toner supply signal, which is issued based on the toner concentration detection signal of toner sensor 12 provided for developing unit 1, the toner is dropped and supplied from a toner falling port (opening port) 19 of slit form through toner entrance port 13 of developing unit 1 to the upstream side of first agitating shaft 10 with respect to its rotational direction.

The drop supplied toner is mixed and agitated with the carrier as they are tribo-electrified by the rotational conveyance force of first agitating shaft 10 and moved to second agitating shaft 11, from which part of the toner is attracted to developer roller 9 by magnetic force so as to be used for image forming (for developing the static latent image) on the photoconductor drum 4.

In the above way, the arrangement of re-circulating the toner collected by cleaning device 6 into toner supply container 2 which is joined to developing unit 1 realizes effective use of toner.

The toner supply container 2 not only has a container function of storing the toner therein for storage and shipment, but also serves as a multi-functional container having the toner agitating function and toner supplying function.

Specifically, toner supply container 2 incorporates agitating means 17 as a rotationally driven agitating means and toner supply roller 18 as a toner supply means inside a casing 20 thereof. This agitating means 17 has a toner conveying sheet 21 made of a flexible material attached thereon so as to agitate the fresh toner with the collected toner and supply the mixture to toner supply roller 18, whereby the toner can be supplied into developing hopper 8 via toner falling port 19 and toner entrance port 13, as already described. Toner collecting port 16 for receiving the collected toner from cleaning device 6 is arranged on the top of casing 20 so that the toner supply container 2 also functions as the final stage of the collecting duct 15. In FIGS. 1 and 2, T denotes the toner.

With the toner supply unit thus configured, in order to prevent toner T from intentionally dropping and leaking from toner falling port 19 and scattering onto the surroundings when toner supply container 2 is joined to developing unit 1, in the embodiment a blocking element 22 made up of a flexible sheet (PET film) of about 0.1 mm to 0.25 mm. thick is provided such that it can elastically deform to cover toner falling port 19 from below, in an openable and closable manner. Here, the material of blocking element 22 is not limited to the above, buy any resin material or a thin metal sheet can be used as long as it can provide necessary flexibility.

Figure 3:
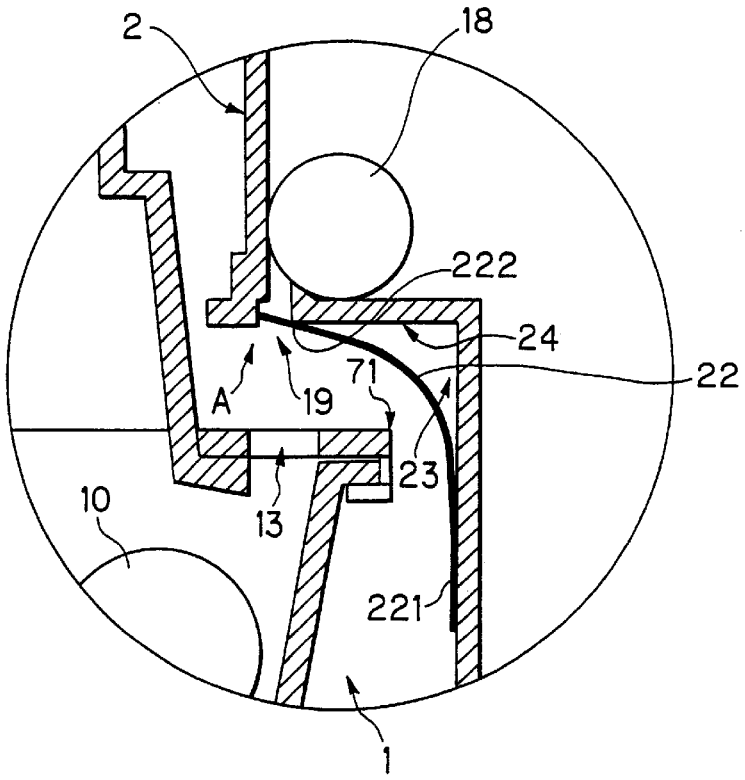
FIG. 3 is an enlarged view showing the arrangement of the same container in the surroundings of its opening port in its separated position.

FIG. 3 is an enlarged view of FIG. 1 showing the surroundings of toner falling port 19, in which toner supply container 2 is not joined to, or is separated from, developing unit 1. In this state, blocking element 22 is curved (elastically deformed) in the direction of its length (the direction perpendicular to the document) so that the distal end portion blocks in close contact with toner falling port 19. Therefore, toner T in toner supply container 2 can be kept confined without leaking out.

Detailedly, blocking element 22 is provided as a strip and is arranged in such a manner that its first edge portion 221 on the fixed side is fixed to the upright exterior wall, designated at 23, with adhesives, and starts curving while the second edge portion 222 on the distal side urges by its elasticity against toner falling port 19 formed in the exterior wall, designated at 24, disposed facedown and comes in close contact from below to block the toner falling port 19. In this state, the second edge portion 222 of blocking element 22 is positioned at a closing position A.

Figure 4:
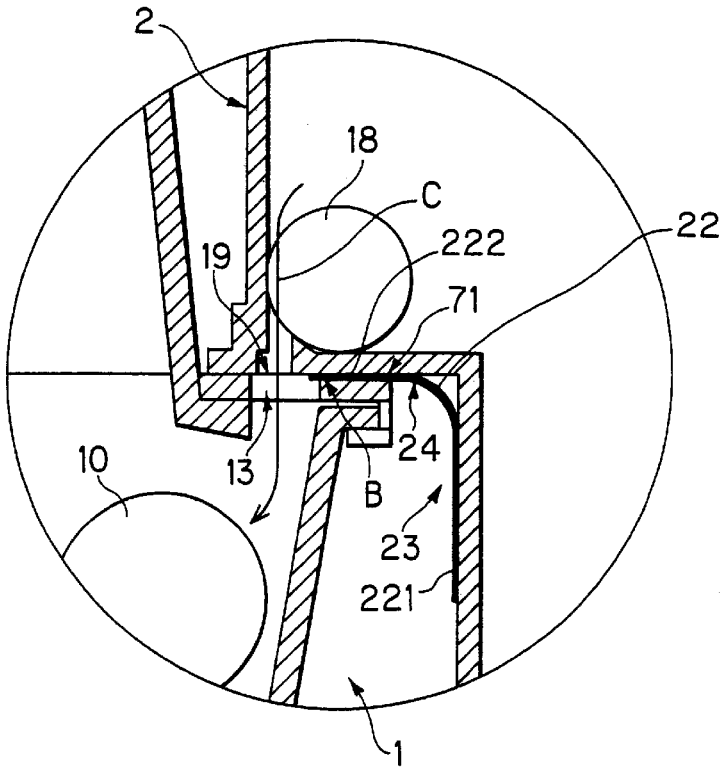
FIG. 4 is an enlarged view showing the arrangement of the same container in the surroundings of its opening port in its joined position.

FIG. 4 is an enlarged view of FIG. 2 showing the state in which toner supply container 2 is joined to developing unit 1 and blocking element 22 is held tightly between developing unit 1 (its corner edge 71 of casing 7) and toner supply container 2 (its exterior wall 24) so that the curved portion is elastically deformed to a greater extent. As a result, the blocking element 22 is approximately set along the exterior walls 23 and 24 of toner supply container 2, which are arranged in an L-shape when sectionally viewed, while its second edge portion 222 is drawn back at a retracted position B to thereby release toner falling port 19.

That is, blocking element 22 is adapted to be deformed to a greater extent by receiving a force that acts on the curved portion formed along its length, from the corner edge 71 of casing 7 of developing unit 1 and exterior wall 24 of toner supply container 2, to thereby release toner falling port 19. In the figure, an arrow C denotes the flow of toner.

In the above way, blocking element 22 is elastically deformed when toner supply container 2 and developing unit 1 are joined to each other or separated one from another, so as to open and close toner falling port 19. In its separated state as shown in FIG. 3, the second edge portion 222 of blocking element 22 resides at the closing position A so that toner falling port 19 is closed. In its joined state as shown in FIG. 4, blocking element 22 is greatly curved so that the second edge portion 222 is drawn back to the retracted position B and toner falling port 19 is open.

Accordingly, it is possible to open toner falling port 19 by joining developing unit 1 and toner supply container 2, without the necessity of any other extra operation. When the toner supply container 2 is separated from developing unit 1, it is possible to close toner falling port 19 without the necessity of any other extra operation. Here, it is preferred that deformation of blocking element 22 should be designed to fall within the limit of its elasticity.

In the above configuration shown in FIGS. 1 and 2, since joining and separation of developing unit 1 and toner supply container 2 are carried out at the same time the developing unit is made to close to or separate from photoconductor drum 4 (without the need to join and separate, independently), the operativity and work performance can be markedly improved. That is, when toner is re-supplied to toner supply container 2 or when toner supply container 2 is replaced with a new one, developing unit (developing portion) 1 is separated first from photoconductor drum 4 and then toner supply container 2 is drawn out (pulled out) to the front side.

Thereafter, toner is re-supplied from the toner bottle or the like into toner supply container 2 which has been drawn out to the front side, the toner supply container 2 is returned to the original position (or a new toner cartridge is inserted into place as in the state shown in FIG. 1), and then developing unit 1 is set in proximity to photoconductor drum 4 to complete the assembly.

At that point, blocking element 22 is largely curved by being held between developing unit 1 (corner edge portion 71 of casing 7) and toner supply container 2 (exterior wall 24) so that the second edge portion 222 moves to the retracted position B hence toner falling port 19 opens. That is, the external force to be acted on blocking element 22 to cause toner falling port 19 to open can be obtained when developing unit (developing portion) 1 is moved from the retracted position to the proximal position with respect to photoconductor drum 4.

In other words, in order to cause blocking element 22 that is closing toner falling port 19 to move to its retracted position B, the external force to be acted on the curved portion formed along the length of blocking element 22 can be obtained by moving developing unit (developing portion) 1 from the retracted position to the proximal position with respect to photoconductor drum 4. Other than the above configuration, for example, development unit 1 and toner supply container 2 may be joined outside image forming apparatus 3 first and then may be integrally put into place inside the machine.

As described heretofore, the elasticity of blocking element 22 is made use of to confine toner falling port 19 by its force, and toner falling port 19 is released by causing an external force to act on the curved portion of blocking element 22 so as to elastically deform the blocking element to a greater degree when toner supply container 2 is set or when toner supply container 2 is attached to developing unit 1 and the developing unit 1 is set in proximity to photoconductor drum 4. Thus, no extra operation or no complicated opening and closing mechanism is needed to manipulate blocking element 22, hence the operativity is markedly improved and the configuration of the apparatus can be simplified, thus making it possible to provide an inexpensive apparatus with less risk of troubles occurring.

Figure 5A:
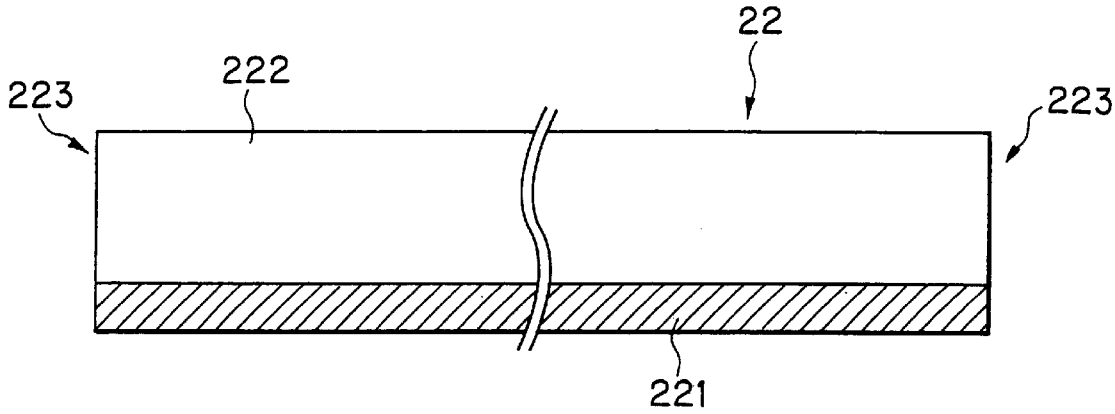
FIGS. 5A to 5C are plane views showing flexible elements for the same container.
Figure 5B:
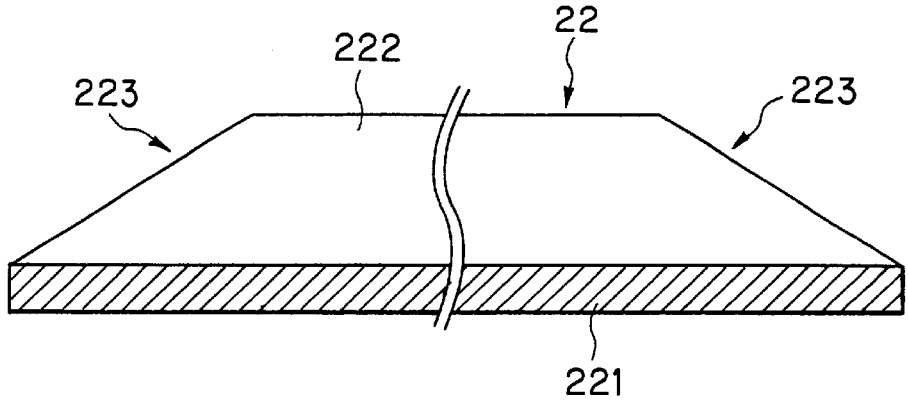
Figure 5C:
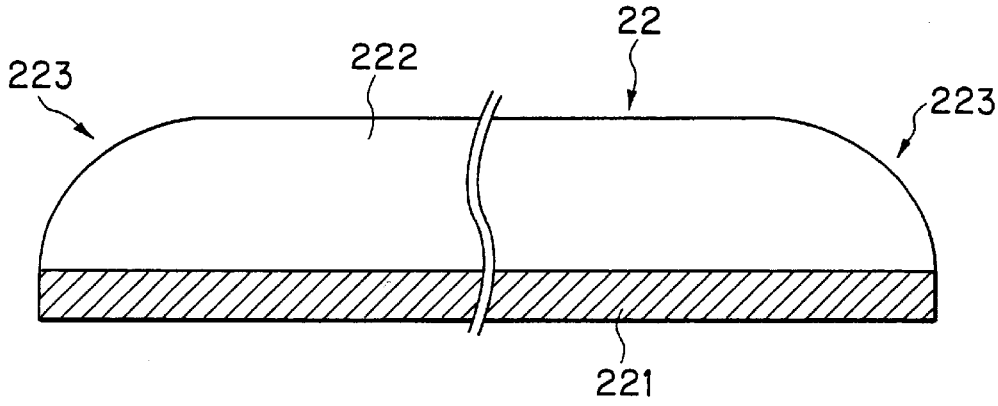

FIGS. 5A to 5C show a variety of blocking elements 22 with different side ends, FIG. 5A showing a blocking element 22 with rectangular shaped side ends. FIG. 5B shows a blocking element 22 with its side ends cut inclined inward toward the distal end, forming edges 223, 223 on its free end side. FIG. 5C shows a blocking element 22 with its side ends shaped in the form of an arc, forming rounded edges 223, 223 on its free end side.

With the blocking element provided in the shape shown in FIG. 5B or 5C, when toner supply container 2 is joined to developing unit 1, the edges 223, 223 at both sides of blocking element 22 come into contact with developing unit 1 over a smaller area (at points). Therefore, interference occurring when it comes in contact can be alleviated so that blocking element 22 becomes unlikely to break.

Next, the effects of the present invention will be described.

In accordance with the first feature of the present invention, use of a flexible element that covers the opening port of the toner supply unit in an openable and closable manner, eliminates the necessity of a complex shutter actuating mechanism and a movable structure that can be opened and closed off, thus making it possible to markedly simplify the structure and provide a lightweight compact unit at low cost.

Further, the opening port can be released by the deformation of the flexible element when the toner supply container is joined to the developing unit, the operativity for attachment and detachment of the unit can be markedly improved without any need of providing a separate, driving source or extra parts.

In accordance with the second feature of the present invention, the opening port can be released and closed off by simply providing a flexible element with its one edge portion fixed to the exterior wall.

In accordance with the third feature of the present invention, it is possible to open or close the opening port using the elasticity of the flexible element itself. That is, when the developing unit and toner supply unit, which have been joined to each other, are separated one from another, the flexible element reverts itself back to the original state by its elasticity thus making it possible to shut off the opening port for toner supply.

In accordance with the fourth feature of the present invention, since the joining operation of developing unit and toner supply unit for releasing the opening port can be made at the same time the developing unit is set close to the photoconductor drum, the dedicated action for joining the developing unit and toner supply unit can be omitted, thus making it possible to improve the operativity and working performance upon attachment and removal.

In accordance with the fifth feature of the present invention, since the edges at both ends of the free end side of the flexible element are cut inclined inward, the edges will come into contact with the frame of the developing unit over a smaller area (at points), thus making it possible to reduce impacts so that the flexible element becomes unlikely to break.

In accordance with the sixth feature of the present invention, since the edges at both ends of the flexible element are rounded on the free end side, the edges will come into contact with the frame of the developing unit in a smaller area (at points), thus making it possible to reduce impacts so that the flexible element becomes unlikely to break.

What is claimed is:

1. A toner supply unit, comprising:

a toner supply container which is attachable to and removable from a developing unit for developing a static latent image formed on a photoconductor drum, and being configured so that toner is supplied to the developing unit through a slit-shaped opening port formed in the toner supply container when the toner supply container has been joined to the developing unit, and a flexible element for covering the opening port in an openable and closable manner is provided so that, when the toner supply container is joined to the developing unit, an external force that acts on the developing unit or toner supply unit deforms the flexible element to uncover the opening port.

2. The toner supply unit according to claim 1, wherein one longitudinal edge portion of the flexible element is fixed to an exterior wall of the toner supply container while another side edge portion of the flexible element located on a free end side covers the opening port of the toner supply container in an openable and closable manner.

3. The toner supply unit according to claim 1, wherein the flexible element has elasticity and the deformation of the flexible element occurring when the toner supply container is joined to the developing unit is adapted to fall within the limit of its elasticity.

4. The toner supply unit according to claim 1, wherein the external force that acts on the flexible element to uncover the opening port is obtained when the developing unit is moved from a retracted position to a proximal position with respect to the photoconductor drum.

5. The toner supply unit according to claim 1, wherein edges at both ends on a free end side of the flexible element are cut inclined inwards toward the free end side.

6. The toner supply unit according to claim 1, wherein edges at both ends on a free end side of the flexible element are rounded on the free end side.

* * * * *